US006871764B2

(12) United States Patent
Stoneberg et al.

(10) Patent No.: US 6,871,764 B2
(45) Date of Patent: Mar. 29, 2005

(54) BEVERAGE CLOSURE WITH OPEN/CLOSE SPOUT AND PROTECTED SEAL SURFACES

(75) Inventors: Thomas C. Stoneberg, Buffalo Grove, IL (US); Terry E. Kubitz, Cary, IL (US); Dennis J. Tortorella, Arlington Heights, IL (US)

(73) Assignee: Creaive Packaging Corp., Buffalo Grove, IL (US)

( * ) Notice: Subject to any disclaimer, the term of this patent is extended or adjusted under 35 U.S.C. 154(b) by 0 days.

(21) Appl. No.: 10/624,924

(22) Filed: Jul. 22, 2003

(65) Prior Publication Data

US 2004/0129741 A1 Jul. 8, 2004

Related U.S. Application Data

(60) Provisional application No. 60/397,974, filed on Jul. 22, 2002.

(51) Int. Cl.[7] ..... B67D 3/00

(52) U.S. Cl. ..... 222/520; 222/546; 222/548; 222/554; 222/563

(58) Field of Search ..... 222/519, 520, 222/522, 523, 525, 546, 548, 549, 552, 554, 563

(56) References Cited

U.S. PATENT DOCUMENTS 351,875 A 11/1886 Marsh
1,949,058 A 2/1934 Leguillon
2,598,403 A 5/1952 Macey
3,107,829 A 10/1963 Makowski
3,141,580 A 7/1964 Rogers
3,191,806 A 6/1965 Schultz et al.
3,276,640 A 10/1966 Kessler
3,439,842 A 4/1969 Stull
3,738,545 A 6/1973 Roy
4,151,924 A 5/1979 Jameson (Continued)

*Primary Examiner*—Michael Mar
*Assistant Examiner*—Patrick Buechner
(74) *Attorney, Agent, or Firm*—Taft, Stettinius & Hollister LLP

(57) ABSTRACT

A closure includes: (a) a base attached to an opening of a container, a conduit extending therethrough in fluid communication with contents of the container, a tubular spout guide defining a portion of the conduit, an annular deck extending radially inwardly from an inner circumferential surface of the base defining a central orifice in fluid communication with the conduit,;and (b) an annular spout mounted to the tubular spout guide for reciprocation between an open position and a closed position, the spout including (1) an annular wall and (2) a plug positioned radially within the annular wall; the plug has annular, outer circumferential seal surface that is received within, and plugs the central orifice of the deck; a portion of the seal surface of the plug is axially recessed or flush with the annular wall of the spout; the seal surface has either a cylindrical shape or a frustoconical shape.

13 Claims, 7 Drawing Sheets

U.S. PATENT DOCUMENTS 4,314,656 A 2/1982 Kessler
4,408,700 A 10/1983 Fillmore et al.
4,497,765 A 2/1985 Wilde et al.
4,749,103 A 6/1988 Barriac
4,826,055 A 5/1989 Stull
4,927,065 A 5/1990 Beck
4,967,941 A 11/1990 Beck
4,979,648 A 12/1990 Montgomery et al.
5,104,008 A 4/1992 Crisci
5,112,628 A 5/1992 Conrad
5,145,094 A 9/1992 Perlmutter
5,169,035 A 12/1992 Imbery, Jr.
5,328,063 A 7/1994 Beck et al.
5,332,127 A 7/1994 White
5,429,282 A 7/1995 Stebick
5,472,120 A 12/1995 Stebick et al.
5,577,625 A 11/1996 Baird et al.
5,588,562 A 12/1996 Sander et al.
5,620,117 A 4/1997 Bieze et al.
5,743,444 A 4/1998 Beck et al.
5,810,185 A 9/1998 Groesbeck
5,829,609 A 11/1998 Beck
5,829,611 A 11/1998 Beck
5,975,369 A 11/1999 Yurkewicz et al.
6,135,329 A 10/2000 Stoneberg et al.
6,213,351 B1 * 4/2001 Stoneberg et al. ..... 222/153.14
6,257,463 B1 7/2001 De Polo
6,299,038 B1 10/2001 Schmeisser et al.
6,321,924 B1 11/2001 Yurkewicz et al.
6,338,425 B1 1/2002 Berge et al.
6,772,910 B1 * 8/2004 Coory ..... 222/83

* cited by examiner

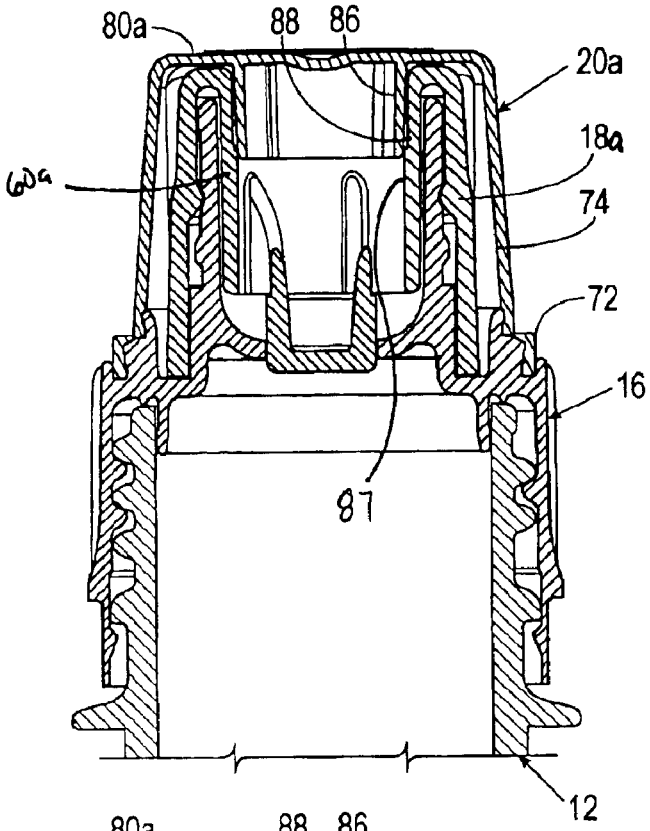
*Fig.* 9
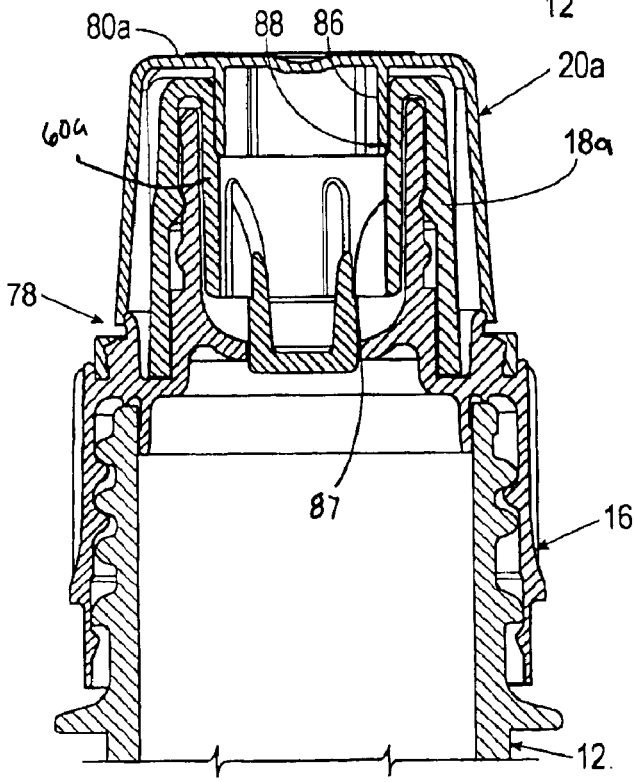
*Fig.* 10

BEVERAGE CLOSURE WITH OPEN/CLOSE SPOUT AND PROTECTED SEAL SURFACES

CROSS-REFERENCE TO RELATED APPLICATIONS

The present application claims priority to the provisional patent application entitled "CLOSURE FOR A CONTAINER", U.S. Ser. No. 60/397,974, filed on Jul. 22, 2002, the entire content of which is hereby incorporated herein by reference.

BACKGROUND

The present application is related to closures for beverage containers; and more specifically, to a closure having an open/close type spout and plug, where the sealing surfaces within the closure are reduced and/or are protected from damage, thereby improving the performance and consistency of the closure product. This application is relevant to both push/pull type spouts and to twist open/close spouts.

Prior art closures having an open/close type spout and plug typically include at least two components: a base component that attaches to the throat of a beverage container, and a spout component that is carried on the base component and is adapted to be reciprocated between and open and close position with respect to the base component by a consumer. Typically, the base component includes an opening coaxial with the throat of the beverage container and a coaxial plug extending from the opening, and the spout component includes a coaxial orifice that is in fluid communication with the opening of the base component when the spout is in its open position and that is plugged by the plug of the base component when the spout component is in its closed position. It also known to provide the plugs on the spout component rather than the base component, which cooperate with an orifice on the base component.

With such closures, the base and spout components are typically molded separately from thermoplastic materials and later assembled together in an assembly operation. Furthermore, with such prior art closures, the plugs of the base or spout components extend outwardly from the component. Thus, during the molding process, the plug's sealing surface (which will seal against the corresponding sealing surface of the orifice) can be scratched or damaged due to impacting the mold components while being stripped off or ejected from the cores of the mold. The sealing surface is also subject to slight damage during the sorting and handling that occurs during the automatic assembly process of the closure, as well as the manipulation that occurs during filling and final assembly of the closure to the container. The scratching and damage that occurs can create a seal failure which is more severe when trying to hold a positive or negative pressure in the container.

A third component often included with such closures is a removable overcap component, which is attached over the spout component to the base component to protect the spout component from contamination during shipping and handling. Some prior art overcaps are also capable of being reattached by the consumer after initial removal. There are two common ways to make a prior art overcap tamper-evident (i.e., notify the consumer that the overcap had been previously removed after the initial bottling operation). One way is to design the overcap with a straight wall which locks onto or into the base when applied. The wall is molded with perforations or is cut with perforated blade in a post molding operation. The perforations break; leaving a portion of the wall attached to the base cap when the consumer opens the closure for the first time.

The second common prior art design for a tamper evident overcap has an outer ring that locks into or onto the base cap. The ring is attached to the overcap via bridges. The bridges break the first time the overcap is opened, leaving the ring attached to the base.

Both designs have had limited tamper evident success because the only way the consumer can determine whether the closure has been previously opened is by the feel of the bridges breaking or the sound of the bridges breaking. When the overcap is re-applied after the initial opening, it is difficult to see if the closure has been opened since the overcap is in the same position in relation to the portion that was broken prior to opening.

SUMMARY

The present application is related to closures for beverage containers; and more specifically, to a closure having an open/close type spout and plug, where the sealing surfaces within the closure are reduced and/or are protected from damage, thereby improving the performance and consistency of the closure product. This application is relevant to both push/pull type spouts and to twist open/close spouts.

The present application is also related to an closure having an overcap and closure-base combination that provides a clear indication to the consumer that the overcap has been removed subsequent to the initial bottling operation.

Accordingly, it is a first aspect of the invention to provide a closure for a beverage container that includes: (a) a base adapted to be attached to an opening of a liquid container, where the base includes a conduit extending therethrough that is adapted to be in fluid communication with liquid contents of the liquid container, where the base further includes a substantially tubular spout guide defining at least a portion of the conduit, and where the base further includes an annular deck extending radially inwardly from an inner circumferential surface of the base defining a central orifice in fluid communication with the conduit; and (b) a substantially annular spout mounted to the tubular spout guide for reciprocation at least between an open position and a closed position, the spout including (1) an annular wall and (2) a plug positioned radially within the annular wall; where the plug has annular, outer circumferential seal surface that is received within, and plugs the central orifice of the deck when the spout is in the closed position and that is removed from the central orifice deck when the spout is in the open position; where at least a substantial portion of the outer circumferential seal surface of the plug is axially recessed or flush with respect to the annular wall of the spout; and where the outer circumferential seal surface has either a smooth cylindrical shape with a substantially constant diameter or a smooth frustoconical shape having a diameter that widens with the distance from the leading end. The annular wall of the spout protects the substantial portion of the seal surface from damage during the molding and assembly operations; and, further, the shape of the plug and corresponding mold makes the plug less susceptible to damage when the spout is axially ejected from a mold after a molding operation.

In a more detailed embodiment of the first aspect of the invention, the annular wall of the spout is an outer annular wall of the spout.

In an alternate detailed embodiment of the first aspect of the invention, the spout is threaded to the tubular spout guide so that the spout is twisted with respect to the base to reciprocate the spout between the open and closed positions.

In another alternate detailed embodiment of the first aspect of the invention, the base includes: an internally threaded, substantially cylindrical wall for threading onto a throat of a correspondingly threaded container; and an annular top surface extending radially inwardly from the internally threaded, substantially cylindrical wall; where the tubular spout guide extends coaxially upwardly from the annular top surface; and where the annular deck extends from in inner circumferential surface of (x) the internally threaded, substantially cylindrical wall, (y) the annular top surface, or (z) the tubular spout guide. In a more detailed embodiment, the deck has a shape in an elevational cross section that is either a substantially concave shape or a substantially convex shape. In yet a further detailed embodiment, the deck is flexible and substantially resilient.

It is a second aspect of the invention to provide a closure for a container adapted to contain a liquid that includes: a base adapted to be attached to an opening of a liquid container, where the base includes a conduit extending therethrough that is adapted to be in fluid communication with liquid contents of the liquid container when attached to the opening of the liquid container, and where the base further includes a substantially tubular spout guide defining at least a portion of the conduit and a plug positioned radially within the tubular spout guide; and a substantially annular spout mounted to the tubular spout guide for reciprocation at least between an open position and a closed position, where the spout includes an annular wall and an annular deck extending radially inwardly from an upper end of the annular wall forming a central orifice; where the plug has an annular, outer circumferential seal surface that is received within, and plugs the central orifice of the deck when the spout is in the closed position and that is removed from the central orifice deck when the spout is in the open position; and where at least a substantial portion of the outer circumferential seal surface of the plug is axially recessed or flush with respect to the tubular spout guide such that the tubular spout guide protects the substantial portion of the seal surface from damage during the molding and assembly operations.

In a more detailed embodiment of the second aspect of the invention, the outer circumferential seal surface has a shape that is (i) a smooth cylindrical shape having a substantially constant diameter, or (ii) a smooth frustoconical shape having a diameter that widens with the distance from the leading end, such that the plug is less susceptible to damage when the base is axially ejected from a mold after a molding operation.

In an alternate detailed embodiment of the second aspect of the invention, the spout is threaded to the tubular spout guide so that the spout is twisted with respect to the base to reciprocate the spout between the open and closed positions.

In another alternate detailed embodiment of the second aspect of the invention, the base includes: an internally threaded, substantially cylindrical wall for threading onto a throat of a correspondingly threaded container; and an annular top surface extending radially inwardly from the internally threaded, substantially cylindrical wall; where the tubular spout guide extends coaxially upwardly from the annular top surface; and where the plug extends coaxially within the tubular spout guide from at least one bridge extending from the tubular spout guide.

In yet another alternate detailed embodiment of the second aspect of the invention, the deck includes an annular lip extending axially downward from the central orifice providing additional inner circumferential surface area for sealing about the plug when the spout is in the closed position. In a further detailed embodiment, the deck is flexible and substantially resilient.

It is a third aspect fo the present invention to provide a closure for a container adapted to contain a liquid that includes: a base adapted to be attached to an opening of a liquid container, where the base includes a conduit extending therethrough that is adapted to be in fluid communication with liquid contents of the liquid container when attached to the opening of the liquid container, where the base further includes a substantially tubular spout guide defining at least a portion of the conduit, and where the base further includes an annular deck extending radially inwardly from an inner circumferential surface of the base defining a central orifice in fluid communication with the conduit; and a substantially annular spout mounted to the tubular spout guide for reciprocation at least between an open position and a closed position, where the spout includes an annular wall and a plug positioned radially within the annular wall; where the plug has an annular, outer circumferential seal surface that is received within, and plugs the central orifice of the deck when the spout is in the closed position and that is removed from the central orifice deck when the spout is in the open position; and where the deck has a shape in an elevational cross section that is either a substantially concave shape or a substantially convex shape.

In a more detailed embodiment of the third aspect of the invention, at least a substantial portion of the outer circumferential seal surface of the plug is axially recessed or flush with respect to the annular wall of the spout such that the annular wall of the spout protects the substantial portion of the seal surface from damage during the molding and assembly operations. In a further detailed embodiment, the outer circumferential seal surface has a shape that is: (i) a smooth cylindrical shape having a substantially constant diameter, or (ii) a smooth frustoconical shape having a diameter that widens with the distance from the leading end, such that the plug is less susceptible to damage when the spout is axially ejected from a mold after a molding operation.

In an alternated detailed embodiment of the third aspect of the invention, the base includes: an internally threaded, substantially cylindrical wall for threading onto a throat of a correspondingly threaded container; and an annular top surface extending radially inwardly from the internally threaded, substantially cylindrical wall; where the tubular spout guide extends coaxially upwardly from the annular top surface; and where the annular deck extends from in inner circumferential surface of (x) the internally threaded, substantially cylindrical wall, (y) the annular top surface, or (z) the tubular spout guide. In a more detailed embodiment, the deck is flexible and substantially resilient.

It is a fourth aspect of the present invention to provide a closure for a container adapted to contain a liquid that includes: a closure assembly adapted to be attached to an opening of a liquid container, where the closure assembly includes a base and a spout extending from the base, and where the closure assembly provides a conduit extending therethrough, when the closure assembly is opened, that is adapted to provide fluid communication with liquid contents of the liquid container and an outlet opening of the spout; a substantially cup-shaped overcap having an annular rim and an annular tamper band extending from the rim by frangible bridges, where the overcap is coupled to the base of the closure assembly over the spout by at least an engagement of the tamper band with the base of the closure assembly upon initial assembly of the closure; and an upward bias provided between the overcap and the closure assembly, where the upward bias is overcome, at least in part, by the frangible bridges when the tamper band is connected to the overcap, and where the upward bias lifts the overcap upwardly with respect to the tamper band when the frangible bridges are broken during an initial removal of the overcap.

In a more detailed embodiment of the fourth aspect of the invention, the upward bias is provided by a bias member of the overcap. In a further detailed embodiment, the overcap includes a substantially cylindrical or conical outer wall and a top wall, where the top wall is substantially concave and is substantially flexible and resilient to provide the bias member that biases against an upper end of the spout of the closure assembly.

In an alternate detailed embodiment of the fourth aspect of the invention, the bias member extends downwardly from an upper inner surface of the overcap to bias against the closure assembly. In a further detailed embodiment, the bias member is a projection extending downwardly from an inner surface of the overcap to bias against the closure assembly. In yet a further detailed embodiment, the bias member is a projection which extends at least partially in a vertical direction to bias against a deflecting surface of the closure assembly that extends at least partially in a vertical direction, where the radial position of the bias member and the deflecting surface of the closure assembly interfere with one another to cause the bias member to deflect upon initial assembly of the closure. In yet a further detailed embodiment, the closure assembly includes a catch or a groove above the deflecting surface of the closure assembly to capture the bias member when the overcap is reattached to the closure assembly after the initial removal of the overcap. The closure may include a plurality of the bias members and a respective plurality of the deflecting surfaces.

In yet another alternate detailed embodiment of the fourth aspect of the invention, the closure further incldues a coupling for reattaching the overcap to the closure assembly after initial removal of the overcap. In a further detailed embodiment, the coupling includes an annular groove provided on a first one of the overcap and closure assembly for receiving an annular lip on the other one of the overcap and closure assembly. Alternatively the coupling may include a radially extending groove provided on a first one of the overcap and closure assembly for receiving an radially extending projection provided on the other one of the overcap and closure assembly.

In yet another alternate detailed embodiment of the fourth aspect of the invention, the upward bias lifting the overcap upwardly with respect to the tamper band when the frangible bridges are broken during an initial removal of the overcap provides a vertical gap between the overcap and the tamper band that is larger than the original vertical height of the frangible bridges to thus provide a visual indication (a visual gap) to a consumer that the overcap has been initially removed from and reattached to the closure assembly.

It is a fifth aspect of the present invention to provide a closure for a container adapted to contain a liquid that includes: a closure assembly adapted to be attached to an opening of a liquid container, where the closure assembly includes a base and a spout extending from the base, and where the closure assembly provides a conduit extending therethrough, when the closure assembly is opened, that is adapted to provide fluid communication with liquid contents of the liquid container and an outlet opening of the spout; a substantially cup-shaped overcap having an annular rim and an annular tamper band extending from the rim by frangible bridges, the overcap being coupled to the base of the closure assembly over the spout at an original height with respect to the base by at least an engagement of the tamper band with the base of the closure assembly upon initial assembly of the closure, where the tamper band is engaged with the base such that the frangible bridges are broken during an initial removal of the overcap; and a coupling for reattaching the overcap to the closure assembly after initial removal of the overcap at a vertical height with respect to the base that is higher than the original height to provide a visual indication that the overcap has been initially removed from and reattached to the closure assembly.

BRIEF DESCRIPTION OF THE DRAWINGS

FIG. 9 is a cross-sectional view another exemplary embodiment where the closure has an overcap with at least one rib interfering with an inner surface of a spout of the closure;

FIG. 10 is a cross-sectional view of the closure depicted in FIG. 9 where the bias of the rib has lifted the overcap a distance upwardly to create a visual gap;

DETAILED DESCRIPTION

Figure 1:
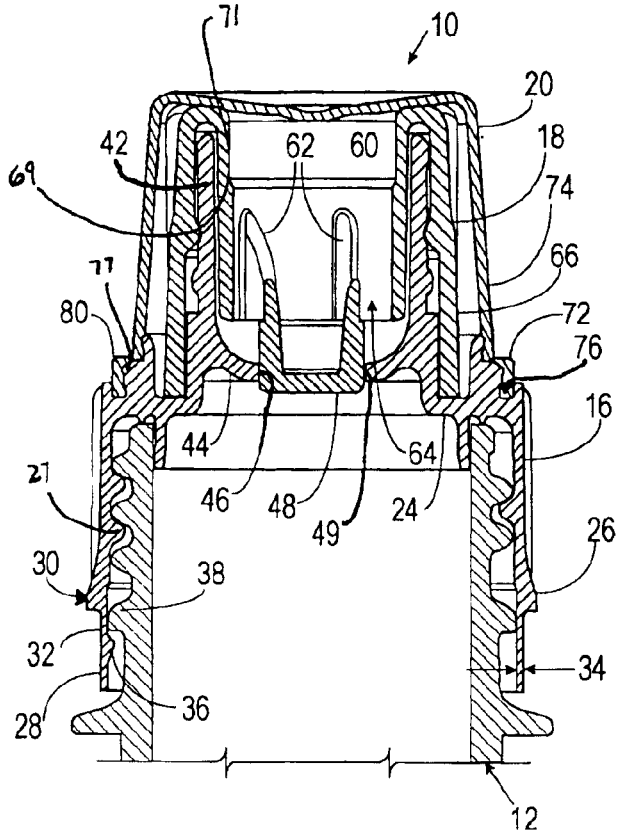
FIG. 1 is an elevational, cross-sectional view of an exemplary embodiment of a closure in accordance with the present inventions.
Figure 2:
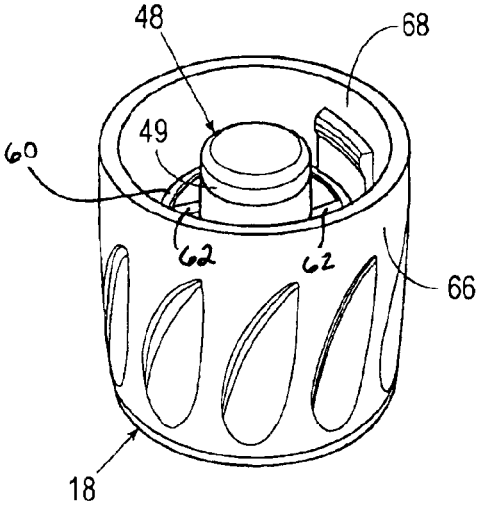
FIG. 2 is an elevational, cross-sectional view of a spout component of the closure of FIG. 1.
Figure 3:
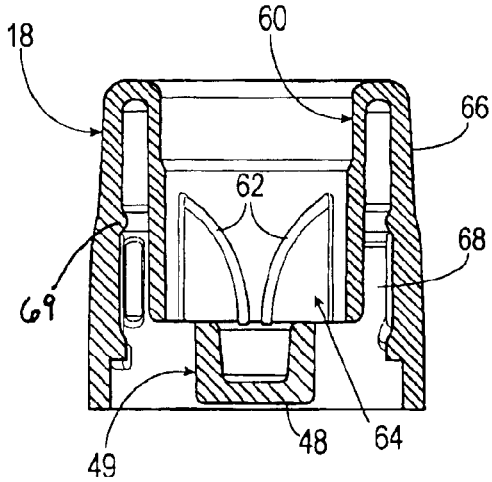
FIG. 3 is a perspective view of an underside of the spout of FIG. 2.

Referring now to the drawings, and in particular to FIGS. 1–3, shown therein is an exemplary embodiment of a closure 10 for a container 12, such as a bottle. The closure 10 includes a base 16, a spout 18, and an overcap 20. The base 16 is adapted to be threaded onto the container 12. The base 16 includes a generally cylindrical sidewall 26 including an internal helical thread 27 for threading the base 16 onto a throat of the container 12, an annular top wall 24 extending radially inward from the upper end portion of the sidewall, and an annular tamper band 28 extending from a lower end 30 of the sidewall 26. The tamper band 28 is attached to the side wall 26 with a plurality of bridges 32 formed by a cutting process subsequent to the molding process. The tamper band 28 has a thickness 34 which is less than that of the sidewall 26 of the base 16. The reduced thickness functions to provide the tamper band 28 with a certain degree of flexibility to facilitate application of the closure 10 to the container 12 during the initial bottling operation. The tamper band 28 can be formed with a continuous annular bead 36 formed along the radially interior surface of the tamper band 28, or a plurality of beads 36 or protrusions which are circumferentially spaced along the radially interior surface of the tamper band 28. The radially inwardly extending bead(s) 36 will cooperate with a radially outwardly extending annular bead 38 formed on the container 12 to lock the tamper band 28 onto the container 12 during the initial bottling operation. Thus, as the base 16 is first removed from the container 12 by the consumer, the bridges 32 will be broken, leaving the tamper band 28 seated below the annular bead 38 on the container and providing a visual indication to the user.

The base 16 further includes a tubular spout guide 42 extending coaxially upwardly from the top wall 24. The tubular spout guide 42 is provided with a radially inwardly extending annular deck 44 at its lower end that provides a coaxial orifice 46 for receiving a plug 48 of the spout 18 when the spout is in its closed position as shown in FIG. 1. The deck 44 is substantially bowl shaped (i.e., concave) and extends generally downwardly from the interior surface of the tubular spout guide 42 near a lower end of the tubular spout guide 42 above the top wall 24 of the base 16. It should be understood that the deck 44 can also be designed to dome upwardly as will be described further below (See FIG. 14).

Figure 4:
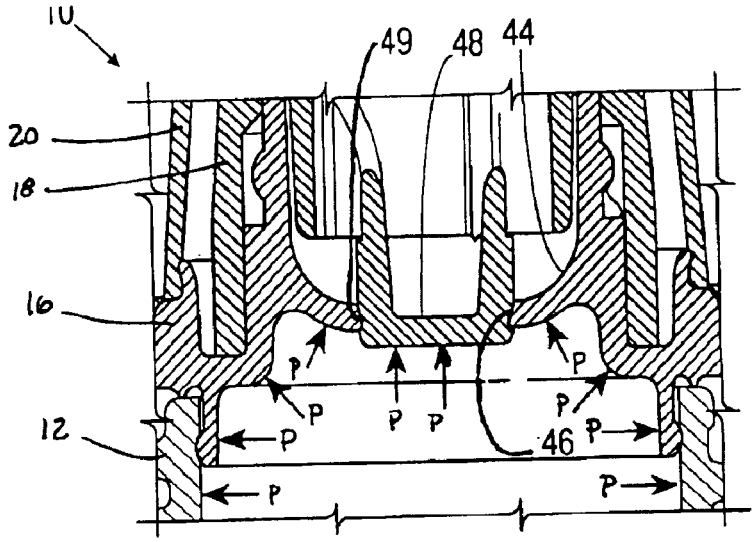
FIG. 4 is an enlarged partial view of FIG. 1 where arrows have been added to show internal pressures on the closure.

FIG. 4 illustrates internal pressure on the plug 48 and the deck 44 (as illustrated by the arrows following letter P). If the container 12 has a positive internal pressure, the pressure will push against the lower surface of the deck 44. Therefore, due to the bowl- or substantially concave shape of the deck 44, the pressure against the lower surface of the deck 44 will cause the deck to abut against a circumferential sealing surface 49 of the plug 48 with greater force, thus improving the seal between the deck 44 and the plug 48.

As will be understood by one skilled in the art, the thickness of the deck 44 can vary widely and is selected such that the deck 44 is deflectable for the purposes discussed herein. Typically, the thickness of the deck 44 will be in a range from about 0.025 inches to about 0.055 inches depending on 1) the resiliency of the material utilized to construct the deck 44, the size of the tubular spout guide 42, and the distance from the orifice 46 to the tubular spout guide 42. For example, as the resiliency of the material increases, the thickness of the deck 44 can decrease, and vice versa.

Similarly, the deck 44 can be constructed of any material having some flexibility and is manufacturable to the configurations shown in the drawings and discussed herein. For example, the base 16 can be constructed of a thermoplastic or UV curable material, such as polyethylene, polypropylene or polyurethane.

In the exemplary embodiments, the angle of the deck 44 can vary from about 8 degrees to 30 degrees.

Referring specifically now to FIG. 3, the spout 18 includes an outer cylindrical wall 66, a coaxial inner cylindrical wall 60, and the coaxial plug 48 extending downwardly from the inner cylindrical wall by way of one or more bridge(s) 62 to form at least one fluid flow passageway 64 between the inner cylindrical wall and the plug. Although the spout 18 will be described hereinafter as having at least two bridges 62 forming at least two fluid flow passageways 64, it should be understood that the spout 18 can be provided with only one bridge 62, or only one fluid flow passageway 64. The bridges 62 are spaced a distance apart to form the fluid flow passageways 64. The bridges 62 can be arranged with any suitable configuration to form the fluid flow passageways 64. For example, the bridges 62 can extend radially or non-radially from the plug 48, randomly or in any other suitable pattern.

A cylindrical cavity 68 provided between the outer cylindrical wall 66 and the inner cylindrical wall 60 is sized and dimensioned to receive the tubular spout guide 42 of the base 16 and includes an internal thread 69 for engagement with an external thread 71 of the spout guide 42. Thus, the spout 18 is received over the tubular spout guide 42 of the base 16 and preferably is adapted to move between an open position (where the plug 48 is removed upwardly from the orifice 46) and a closed position by rotation of the spout 18 relative to the tubular spout guide 42 along a helical threads 69/71. The spout 18 can also be a push-pull type of spout in an alternate embodiment.

Referring again to FIGS. 1–3, the outer circumferential surface of the plug 48 defines the seal surface 49 that abuts and seals against the inner circumferential surface of the orifice 46 in the deck 44 when the spout is in the closed position as shown in FIG. 1. To protect the seal surface 49 against damage due to manufacturing and handling, the seal surface 49 is axially (i.e., upwardly) recessed within the outer cylindrical wall 66 such that the seal surface 49 is protected from damage by the outer cylindrical wall 66. While the sidewall 66 of the exemplary embodiment projects downward below the plug 48, it is within the scope of the invention that the outer cylindrical wall 66 can also be designed to project down over and protect only a portion of the outer cylindrical surface of the plug 48, where such protected portion provides the annular sealing surface 49 as discussed above. This concept can also be used with a push-pull design spout, and can be used with various other types of open/close spout and plug configurations.

Figure 5:
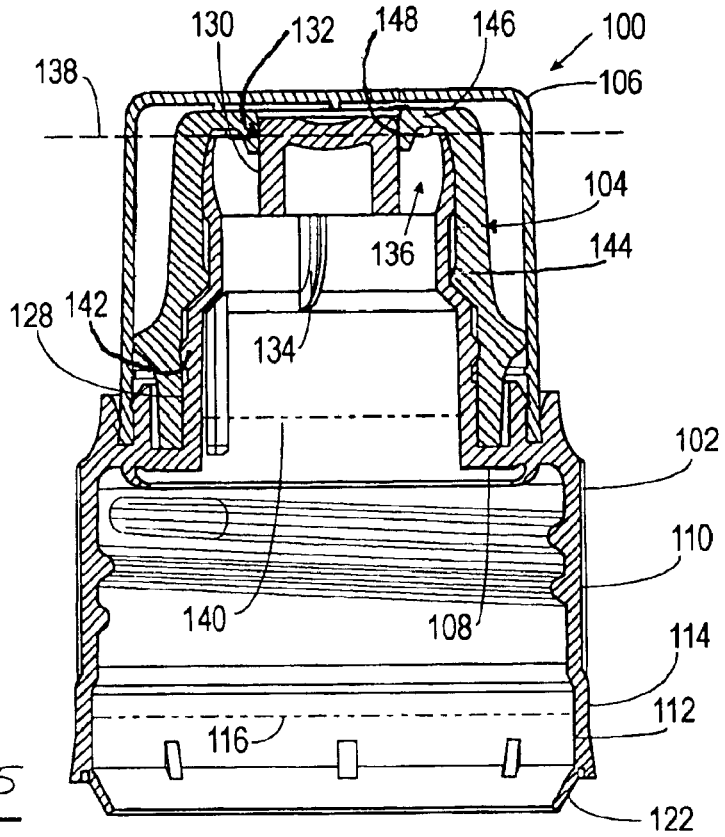
FIG. 5 is an elevational, cross-sectional view of another exemplary embodiment of a closure in accordance with the present invention.
Figure 6:
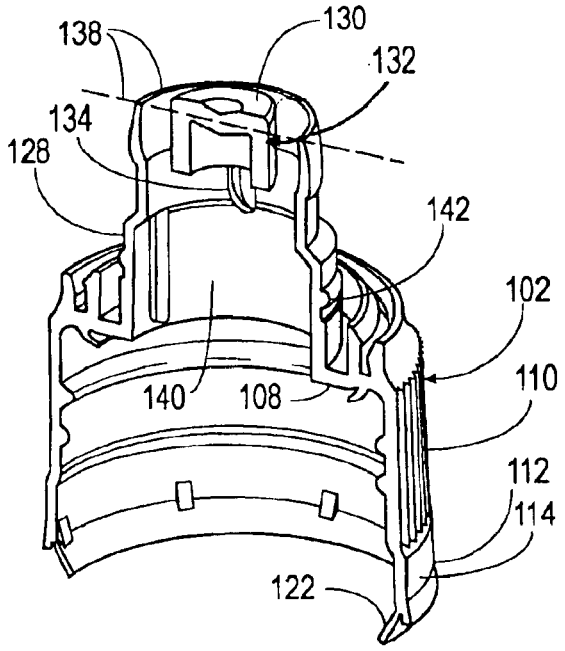
FIG. 6 is a cut-away perspective view of a base of the closure depicted in FIG. 5.

For example, as shown in FIGS. 5 and 6, an alternate embodiment of a closure 100 with a open/close spout and plug configuration is provided, where the sealing surface of the plug is protected. Specifically, the closure 100 is configured to be connected to the container. The closure 100 includes a base 102, a spout 104, and an overcap 106. The overcap 106 can be constructed in a similar manner as the overcaps 20, 20*a* or 20*b* as described herein.

The base 102 is adapted to be threaded onto the container. The base 102 includes a generally cylindrical sidewall 110, an annular top wall 108 extending radially inward from the upper end portion of the sidewall, and the annular tamper band 112 connected to a lower end 114 of the sidewall 110. The tamper band 112 is attached to the sidewall 110 with a plurality of bridges 116 formed by a cutting process subsequent to the molding process, or the bridges 116 may be formed by the molding process itself. The tamper band 112 can be formed with a continuous bead 122 formed along the interior surface of the tamper band 112, or a plurality of beads or protrusions which are circumferentially spaced along the interior surface of the tamper band 112. The bead(s) 122 will cooperate with an annular bead formed on the container to lock the tamper band 112 to the container 12.

The base 102 further includes a coaxial tubular spout guide 128 extending upwardly from the top wall 108, and a coaxial plug 130 having an outer circumferential sealing surface 132. The plug 130 is connected to the tubular spout guide 128 with one or more bridge(s) 134 to form at least one fluid flow passageway 136. Although the base 102 will be described hereinafter as having at least two bridges 134 forming at least two fluid flow passageways 136, it should be understood that the base 102 can be provided with only one bridge 134, or only one fluid flow passageway 136.

The tubular spout guide 128 defines a conduit 140 in fluid communication with the fluid flow passageways 136 so that fluid can flow through the conduit 140 and the fluid flow passageways 136 to remove fluid from the container 12. The spout 104 is received over the tubular spout guide 128 of the base 102 and preferably is adapted to move between an open position and a closed position by rotation of the spout 104 relative to the tubular spout guide 128 along a helical thread 142. The spout 104 can also be a push-pull type of spout. The spout 104 includes a substantially cylindrical body 144 having a deck 146 extending radially inwardly from an upper end of the substantially cylindrical body 144 to form a coaxial orifice 148. The plug 130 is positioned within the orifice 148 when the spout 104 is positioned in the closed position such that the sealing surface 132 of the plug abuts the inner circumferential surface of the orifice 148 to form a seal and substantially prevent liquid from passing through the orifice 148.

The plug 130 is supported by the bridges 134 such that at least a substantial portion of the sealing surface 132 of the plug 130 is positioned axially below an upper end 138 of the tubular spout guide 128 so that the tubular spout guide will protect the sealing surface 132 from damage.

With the above embodiments of FIGS. 1–3 and FIGS. 5–6, it is also advantageous that the outer circumferential surfaces of plug 48/130, and especially the seal surfaces 46/132, be substantially cylindrical or at least increase in diameter with the distance from the active end of the plug 46/132 so that the chances that the plug 48/130 will be damaged by the mold upon axial removal of the associated component (the spout component 18 in the embodiment of FIGS. 1–3 and the base component in the embodiment of FIGS. 5–6) from the mold after molding the associated component is reduced.

Referring again to the embodiment illustrated and described with respect to FIGS. 1–3; as shown in FIG. 1, the overcap 20 is adapted to be positioned over the spout 18 when the spout 18 is rotated or otherwise moved to the closed position. The overcap 20 is provided with an annular tamper band 72 that is radially outwardly offset relative to a bottom circumferential edge of a generally conical sidewall 74 of the overcap 20 and attached via molded bridges (not shown). The bridges can also be formed by a cutting process subsequent to the molding process. When the overcap 20 is first attached to the base 16 (i.e., during the bottling of the beverage), the tamper band 72 is disposed in an annular groove 76 formed in upper surface of the top wall 24 of the base 16. The tamper band 72 can be secured within the annular groove 76 by any suitable method. For example, a radially interior surface of the tamper band 72 can be provided with a plurality of circumferentially spaced, radially inwardly extending ribs (Not shown), which are adapted to be received between a plurality of corresponding radially outwardly extending ribs or teeth (Not shown) formed within the groove 76 of the base 16 to prevent rotation or other movement of the tamper band 72.

The annular groove 76 is dimensioned so that at least a portion of the tamper band 72 is visible with respect to the base 16. For example, in the exemplary embodiment approximately the upper two-thirds of the tamper band 72 can extend above the annular groove 76, and thus be visible with respect to the base 16. To prevent removal of the tamper band 72 from the annular groove 76 of the base 16 after the initial bottling operation, the base 16 is provided with a radially extending lip 77 which is designed to capture the tamper band 72 within the annular groove 76 of the base 16. Thus, when the overcap 20 is first removed from the container 12 by the consumer, the bridges will be broken, leaving the tamper band 72 seated within the annular groove 76 and providing a visual indication to the consumer.

Figure 7:
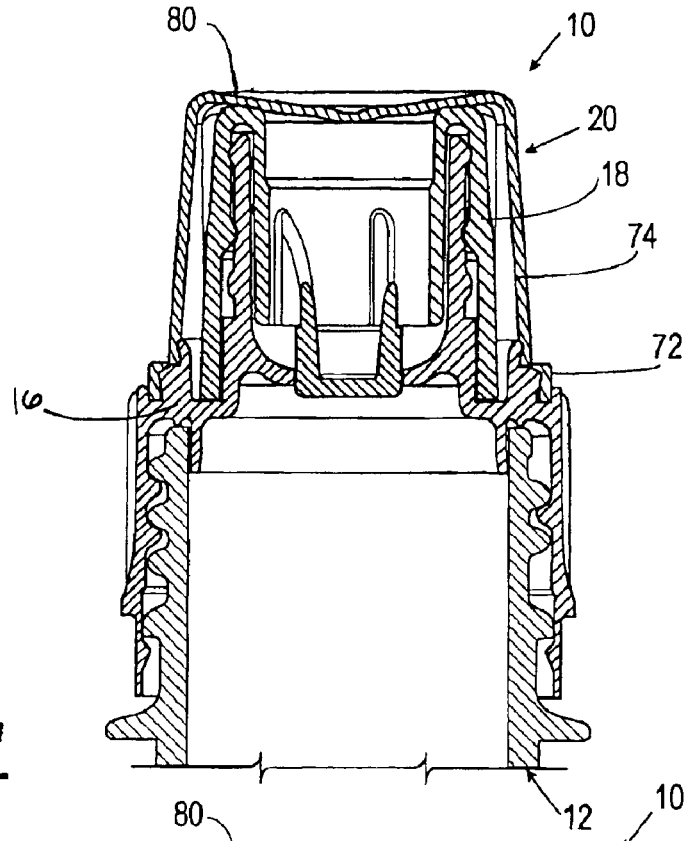
FIG. 7 is another elevational, cross-sectional view of the exemplary embodiment of FIGS. 1–3.
Figure 8:
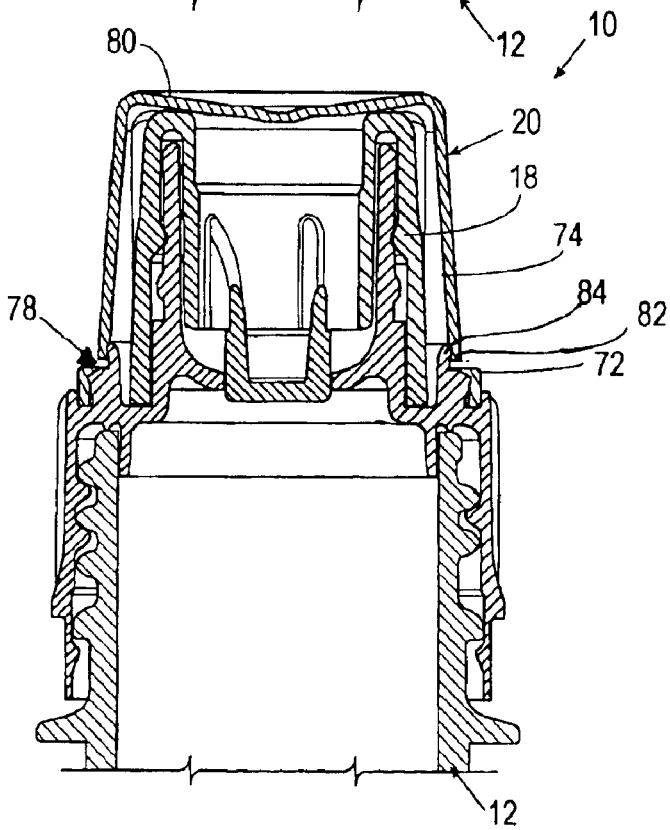
FIG. 8 is a cross-sectional view of the closure depicted in FIG. 7 where the bias of the overcap has lifted the overcap a distance upwardly to create a visual gap.

Referring to FIGS. 7 and 8 in particular, the overcap 20 has been designed to engage with the spout 18 to create an upward bias or pre-load upon initial assembly by the bottler that causes the overcap 20 to lift upwards after initial opening by the consumer. This upward bias of the overcap 20 creates a visible gap 78 (see FIG. 8) between the re-applied overcap 20 and the tamper band 72 that was broken away upon initial opening. This visible gap 78 creates a visual indicator that the overcap 20 had been previously opened.

The device that holds the overcap 20 to the base 16 after initial opening can be designed to allow the overcap 20 to rise in varying amounts to get the desired results.

The manner of causing the overcap 20 to rise and form the visible gap 78 can be varied. For example, as shown in FIGS. 7 and 8, in one embodiment, the overcap 20 is provided with a concave top panel 80 that engages the top surface of the spout 18 and causes deformation of the curved top panel 80 when the overcap 20 is applied to the base 16 during initial bottling to cause the overcap 20 to be in a pre-loaded condition as shown in FIG. 7. The overcap 20 is maintained in the pre-loaded condition by the tamper band 72 and the bridges that connect the tamper band 72 to the sidewall 74 of the overcap 20. When the bridges are broken upon initial removal of the overcap 20, the curved top panel 80 deforms or relaxes to original or an un-loaded condition, thereby causing the visible gap 78 indicating that removal has occurred when the overcap 20 is re-applied to the base 16 (as shown in FIG. 8). The curved top panel 80 is an advantageous design due to the simplicity of construction and the general inability to overcome the natural tendency for the component to reveal access by imparting the visible gap 78. The visible gap 78 is substantially irreversible once the closure 10 has been accessed.

The re-applied overcap 20 can be maintained on the base 16 by any suitable manner. For example, the base 16 and the sidewall 74 of the overcap 20 can be provided with mating, respectively radially inwardly and radially outwardly extending annular lips 82 and 84 (see FIGS. 7 and 8).

Referring now to FIGS. 9 and 10, shown therein and designated by a reference numeral **20*a* is another embodiment of a pre-loaded overcap. The overcap 20*a* includes a downwardly extending rib 86 adapted to abut an inner circumferential surface of the inner cylindrical wall 60*a* of the spout 18*a*. The inner cylindrical wall 60*a* has lower portion 87 with a smaller diameter (distance from the center/axis of the closure) than the outer surface of the rib 86 such that the rib 86 must deflect radially inwardly in the pre-loaded condition as shown in FIG. 9 when the overcap 20*a* is first attached during the initial bottling operation. Above the lower portion 87, is a portion formed by a groove 88 in the inner cylindrical wall with a larger diameter to accommodate the diameter of the rib 86, as well as a shape to accommodate the shape of the rib 86. The overcap 20*a* is maintained in the pre-loaded condition by the tamper band 72 and the bridges which connect the tamper band 72 to the sidewall 74 of the overcap 20***a*. As shown in FIG. 10, when the bridges are broken upon initial removal of the overcap 20*a*, the internal rib 86 deforms or relaxes to original form or an un-loaded condition. And when the overcap 20*a* is re-applied onto the closure, the groove 88 will capture the rib 86, thereby causing the visible gap 78 indicating that initial removal has occurred as shown in FIG. 9. Preferably, the overcap 20*a* is provided with a plurality of the ribs 86, which are spatially disposed to permit each of the ribs 86 to flex or deflect independently. The overcap 20*a* is provided with a top panel 80*a* having any suitable shape, such as planar or curved. The internal rib(s) 86 is connected to the top panel 80*a* and extends generally downwardly from the top panel 80*a*. The internal rib 86 engages the spout 18*a* and causes deformation of the internal rib 86 when the overcap 20*a* is applied to the base 16 during assembly to cause the overcap 20*a* to be in a pre-loaded condition.

Figure 11:
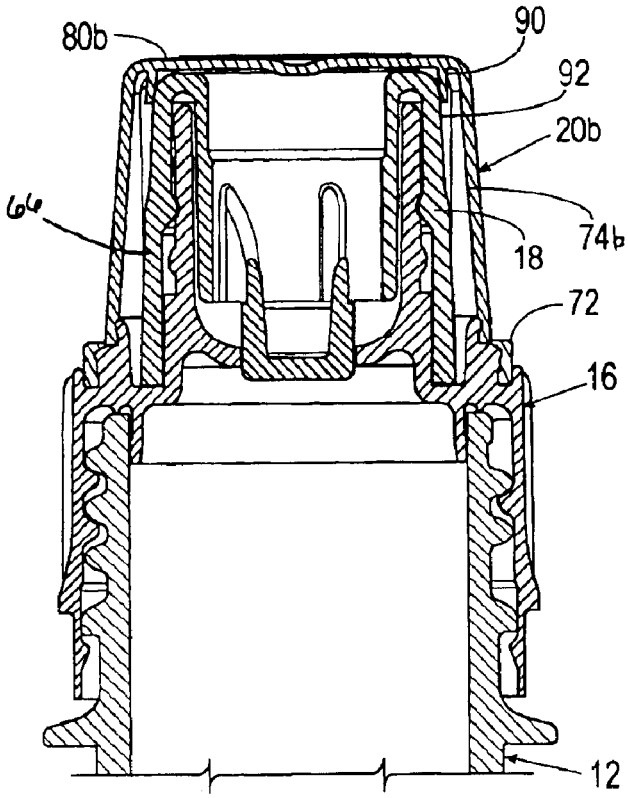
FIG. 11 is an elevational, cross-sectional view another exemplary embodiment where the closure has an overcap with at least one rib interfering with an inner surface of a spout of the closure.
Figure 12:
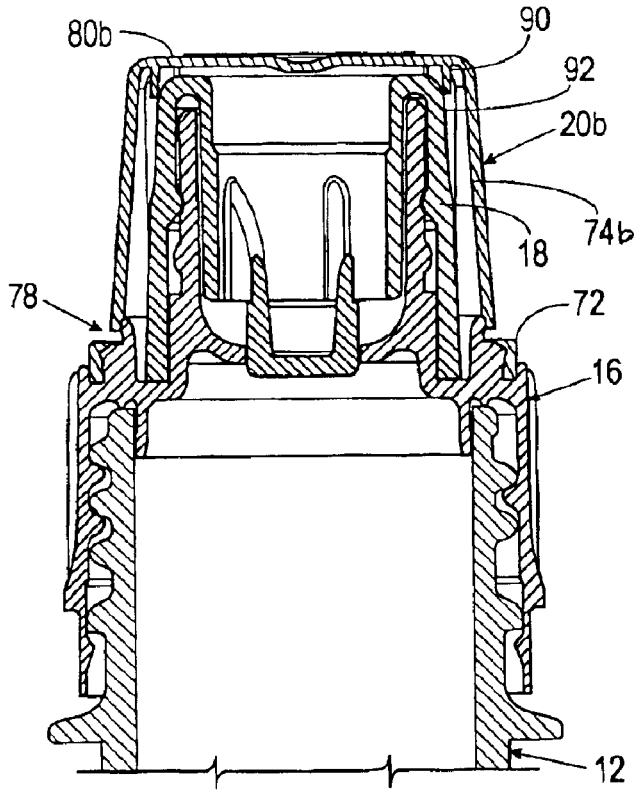
FIG. 12 is a cross-sectional view of the closure depicted in FIG. 11 where the bias of the rib has lifted the overcap a distance upwardly to create a visual gap.

Referring now to FIGS. 11 and 12, shown therein and designated by a reference numeral 20*b* is yet another embodiment of a pre-loaded overcap. The overcap 20*b* includes a downwardly extending rib 90 adapted to abut an outer circumferential surface of the outer cylindrical wall 66 of the spout 18. The outer cylindrical wall 66 is slightly conical having a diameter that widens with the distance from the top end of the spout such that the rib 90 must deflect radially outwardly in the pre-loaded condition as shown in FIG. 11 when the overcap 20*b* is first attached during the initial bottling operation. The overcap 20*b* is maintained in the pre-loaded condition by the tamper band 72 and the bridges which connect the tamper band 72 to the sidewall 74 of the overcap 20*b*. As shown in FIG. 12, when the bridges are broken upon initial removal of the overcap 20*b*, the internal rib 90 deforms or relaxes to original form or an un-loaded condition. And when the overcap 20*b* is re-applied onto the closure, the upper end of the outer wall 60 of the spout having an outer diameter matching the inner diameter of the rib 90 will capture the rib 90, thereby causing the visible gap 78 indicating that initial removal has occurred as shown in FIG. 12. Preferably, the overcap 20*b* is provided with a plurality of the ribs 90, which are spatially disposed to permit each of the ribs 90 to flex or deflect independently. The overcap 20*b* is provided with a top panel 80*b* having any suitable shape, such as planar or curved. The internal rib(s) 90 is connected to the top panel 80*b* and extends generally downwardly from the top panel 80*b*. The internal rib 90 engages the spout 18 and causes deformation of the internal rib 90 when the overcap 20*b* is applied to the base 16 during assembly to cause the overcap 20*b* to be in a pre-loaded condition.

Figure 13:
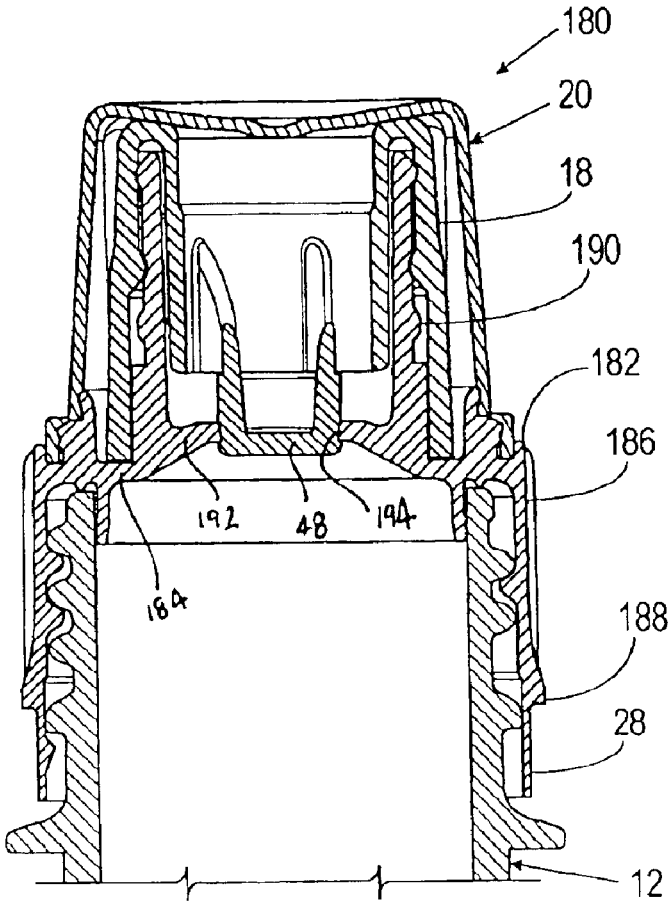
FIG. 13 is an elevational, cross-sectional view of another exemplary embodiment in accordance with the present inventions.
Figure 14:
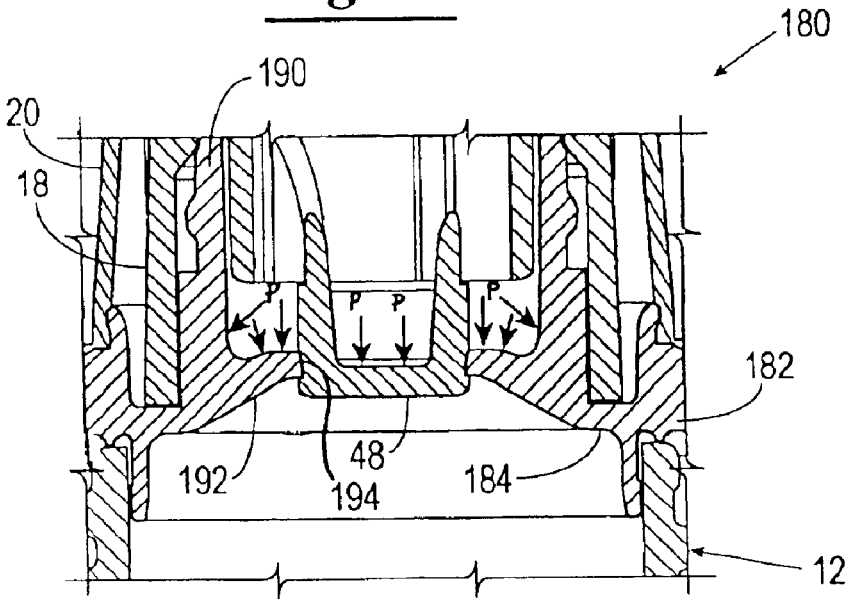
FIG. 14 is an enlarged, partial view of FIG. 13 where arrows have been added to illustrate the relative external pressure on the deck and plug.

Referring to FIGS. 13 and 14, shown therein and designated by a reference numeral 180 is yet another embodiment of a closure 180 constructed in accordance with at least certain aspects of the present invention. The closure 180 is similar in construction and function as the closure 10 (FIGS. 1–3), except as discussed hereinafter. The closure 180 is provided with a base 182, the spout 18, and the overcap 20. The base 182 is adapted to be threaded onto the container 12. The base 182 includes a generally cylindrical sidewall 186, an annular top wall 184 extending radially inward from the upper end portion of the sidewall, and the annular tamper band 28 connected to a lower end 188 of the sidewall 186.

The base 182 further includes a tubular spout guide 190 extending upwardly from the top wall 184. The tubular spout guide 190 is provided with a radially inwardly extending annular deck 192 at its lower end that provides a coaxial orifice 194 for receiving the plug 48 of the spout 18 when the spout is in its closed position as shown in FIG. 14. The deck 192 is convex as it extends generally upwardly from the interior surface of the tubular spout guide 190 near a lower end of the tubular spout guide 190 of the base 182.

The deck 192 of the present embodiment thus extends at an angle generally opposite to the direction of movement of the plug 48 when the plug 48 is inserted into the orifice 194 as the spout 18 is moved from its open to its closed position. In other words, when the plug 48 is moved downwardly to enter the orifice 194, the deck 192 is angled upwardly. This upward angle gives strength to the deck 192 to resist the downward force when the plug 48 is forced into the orifice 194. If any deflection occurs, the deck 192 rebounds which causes the orifice 194 to increase the force against the seal.

This rebounding effect can be increased by having differently designed plugs 48 with tapers or a plug 48 that incorporates a ring or rim larger than the plug portion that would push against the deck 192 when the plug 48 is fully inserted into the orifice 194.

As shown in FIG. 14, when a negative pressure is developed within the container 12, such as the result of hot filling liquids, the vacuum created when the liquid cools may pull the deck 192 in a downward direction. This will also increase the strength of the seal formed between the plug 48 and the deck 192. The pressure on the deck 192, and the plug 48 is illustrated in FIG. 14 by the arrows following letter P.

The components of the closures 10, 100 and 180 can be formed by any suitable process capable of forming material into the various shapes or configurations either discussed above or shown in the attached drawings. For example, the closures 10, 100 and 180, can be constructed of one or more thermoplastic materials using an injection molding process, a compression molding process.

The closures are used in a similar manner. Thus, only the use of the closure 10 will be described hereinafter for purposes of brevity. The container 12 is filled with a medium, such as a liquid, a gas, or some combination of the two, such as a carbonated or non-carbonated beverage via processes known in the art. Then, the closure 10 is connected or applied to the container 12 in any suitable manner, such as by screwing the sidewall 26 to the container 12 while the closure 10 is in the closed position. The container 12 having the closure 10 applied thereto and sealing the material in the container 12 can then be shipped to a retail location, such as a store or an automated dispensing machine. A consumer purchases the container 12 having the closure 10, and then initially removes the overcap 20 (leaving the tamper band 72 within the annular groove 76 in the base 16 as discussed above). The spout 18 is then moved to the open position, such as by twisting the spout 18 along the helical thread, or moving the spout 18 either upwardly or downwardly in a linear fashion. The consumer then either drinks from the spout 18 and/or pours the material out of the spout 18 and into a cup. To reseal the container 12, the spout 18 is moved to the closed position. The overcap 20 can then be reapplied to the base 16 to cover or protect the spout 18, where the visible gap 82 between the overcap 20 and the tamper band 72 indicates that the overcap has been removed at least once.

The materials used in the formation of the base 16 and the spout 18 can vary widely depending upon the desired application of the closure 10. In an exemplary embodiment, the base 16 and the spout 18 are constructed of different materials to avoid cohesive bonding which can occur between similar materials. For example, the base 16 can be constructed of polyethylene and the spout 18 can be constructed of polypropylene.

The base 16 and the spout 18 are typically formed as separate components which are interconnected to form the closure 10 by an automated assembling machine.

The closures 10, 100 and 180 can be used as a liner-less closure for the container 12. The container can be filed with the medium by any suitable process, such as a hot fill process, an ambient fill process, or an aseptic process and the closures 10, 100 and 180 can be applied to the container 12 by a conventional closure applicating machine. The medium can be a beverage having a high sugar content, such as tea or juice, or beverages rich in mineral salts, such as an isotonic beverage.

The pressure maintained within the container 12 by the closures 10, 100 and 180 can vary widely. For example, the medium may be a non-carbonated or low carbonated beverage such that the pressure within the container 12 is less than about +110 lbs/in$^2$ and typically in a range from about ±30 lbs/in$^2$. Positive pressure can be added to the container 12 by inserting liquid nitrogen into the container 12 and then immediately applying the closures 10, 100 or 180 to the container 12. The closures 10, 100 and 180 can be repeatedly opened and closed.

As an example, the closures 10, 100 and 180 can serve as linerless closures for the container 12 which has been filled with a hot-fill process. In the hot-fill process, the medium is heated to about 180° F.–190° F. to kill any bacteria present in the medium. The container 12 is then filled with the heated medium and the closure 10, 100 or 180 is applied immediately while the medium is still hot. The container 12 is then immediately cooled by any manner known in the art, such as by passage of the container 12 through a cold water bath. As the medium cools, a negative pressure will be formed within the container 12 and maintained by the closure. When the closures 10, 100 and 180 are used during the hot-fill process, the closures will typically be constructed of a heat resistant material. For example, the base can be constructed of polypropylene, and the spout can be constructed of polyethylene.

As another example, the closures 10, 100 and 180 can be used for closing containers 12 filled by an aseptic process. In the aseptic process, the medium is heated to about 180° F.–190° F. to kill any bacteria present in the medium. The medium is then cooled to about 80° F.–90° F. The container 12 and the closures 10, 100 and 180 are sterilized and then the containers 12 are filled and capped in a sterile environment. Once the containers 12 are filled and capped, such containers typically cool to room temperature thereby creating a small vacuum, e.g. −2 lbs/in$^2$ within the containers 12.

Following from the above description and invention summaries, it should be apparent to those of ordinary skill in the art that, while the apparatuses herein described and illustrated constitute exemplary embodiments of the present inventions, it is understood that the inventions are not limited to these precise embodiments and that changes may be made therein without departing from the scope of the inventions as defined by the claims. Additionally, it is to be understood that the inventions are defined by the claims and it is not intended that any limitations or elements describing the exemplary embodiments set forth herein are to be incorporated into the meanings of the claims unless explicitly recited in the claims themselves. Likewise, it is to be understood that it is not necessary to meet any or all of the recited advantages or objects of the inventions disclosed herein in order to fall within the scope of any claim, since the inventions are defined by the claims and since inherent and/or unforseen advantages of the present inventions may exist even though they may not have been explicitly discussed herein.

What is claimed is:

1. A closure for a container adapted to contain a liquid comprising:

a base adapted to be attached to an opening of a liquid container, the base including a conduit extending therethrough that is adapted to be in fluid communication with liquid contents of the liquid container when attached to the opening of the liquid container, and the base further including a substantially tubular spout guide defining at least a portion of the conduit, the base further including an annular deck extending radially inwardly from an inner circumferential surface of the base defining a central orifice in fluid communication with the conduit; and a substantially annular spout mounted to the tubular spout guide for reciprocation at least between an open position and a closed position, the spout including (a) an annular wall and (b) a plug positioned radially within the annular wall;

the plug having a leading end and an annular, outer circumferential seal surface that is received within, and plugs the central orifice of the deck when the spout is in the closed position and that is removed from the central orifice deck when the spout is in the open position;

at least a substantial portion of the outer circumferential seal surface of the plug being axially recessed or flush with respect to the annular wall of the spout, whereby the annular wall of the spout protects the substantial portion of the seal surface from damage during the molding and assembly operations; and the outer circumferential seal surface having a shape taken from a group consisting of: (i) a smooth cylindrical shape having a substantially constant diameter, and (ii) a smooth frustoconical shape having a diameter that widens with the distance from the leading end, whereby the plug is less susceptible to damage when the spout is axially ejected from a mold after a molding operation.

2. The closure of claim 1, wherein the annular wall of the spout is an outer annular wall of the spout.

3. The closure of claim 1, wherein the spout is threaded to the tubular spout guide so that the spout is twisted with respect to the base to reciprocate the spout between the open and closed positions.

4. The closure of claim 1, wherein the base includes:

an internally threaded, substantially cylindrical wall for threading onto a throat of a correspondingly threaded container; and an annular top surface extending radially inwardly from the internally threaded, substantially cylindrical wall;

wherein the tubular spout guide extends coaxially upwardly from the annular top surface; and wherein the annular deck extends from in inner circumferential surface of one of (x) the internally threaded, substantially cylindrical wall, (y) the annular top surface, and (z) the tubular spout guide.

5. The closure of claim 4, wherein the deck has a shape in an elevational cross section taken from a group consisting of:

a substantially concave shape; and a substantially convex shape.

6. The closure of claim 5, wherein the deck is flexible and substantially resilient.

7. A closure for a container adapted to contain a liquid comprising:

a base adapted to be attached to an opening of a liquid container, the base including a conduit extending therethrough that is adapted to be in fluid communication with liquid contents of the liquid container when attached to the opening of the liquid container, and the base further including a substantially tubular spout guide defining at least a portion of the conduit, the base further including an annular deck extending radially inwardly from an inner circumferential surface of the base defining a central orifice in fluid communication with the conduit; and a substantially annular spout mounted to the tubular spout guide for reciprocation at least between an open position and a closed position, the spout including (a) an annular wall and (b) a plug positioned radially within the annular wall;

the plug having a leading end and an annular, outer circumferential seal surface that is received within, and plugs the central orifice of the deck when the spout is in the closed position and that is removed from the central orifice deck when the spout is in the open position; and the deck has a shape in an elevational cross section taken from a group consisting of: a substantially concave shape and a substantially convex shape.

8. The closure of claim 7, wherein at least a substantial portion of the outer circumferential seal surface of the plug is axially recessed or flush with respect to the annular wall of the spout, whereby the annular wall of the spout protects the substantial portion of the seal surface from damage during the molding and assembly operations.

9. The closure of claim 8, wherein the outer circumferential seal surface has a shape taken from a group consisting of: (i) a smooth cylindrical shape having a substantially constant diameter, and (ii) a smooth frustoconical shape having a diameter that widens with the distance from the leading end, whereby the plug is less susceptible to damage when the spout is axially ejected from a mold after a molding operation.

10. The closure of claim 7, wherein the annular wall of the spout is an outer annular wall of the spout.

11. The closure of claim 7, wherein the spout is threaded to the tubular spout guide so that the spout is twisted with respect to the base to reciprocate the spout between the open and closed positions.

12. The closure of claim 7, wherein the base includes:

an internally threaded, substantially cylindrical wall for threading onto a throat of a correspondingly threaded container; and an annular top surface extending radially inwardly from the internally threaded, substantially cylindrical wall;

wherein the tubular spout guide extends coaxially upwardly from the annular top surface; and wherein the annular deck extends from in inner circumferential surface of one of (x) the internally threaded, substantially cylindrical wall, (y) the annular top surface, and (z) the tubular spout guide.

13. The closure of claim 12, wherein the deck is flexible and substantially resilient.

* * * * *